US008353320B2

(12) United States Patent
Poeschl

(10) Patent No.: US 8,353,320 B2
(45) Date of Patent: Jan. 15, 2013

(54) DEVICE FOR BOTTLING PARTICLE-CONTAINING BEVERAGES

(75) Inventor: Stefan Poeschl, Regensburg (DE)

(73) Assignee: Krones AG (DE)

( * ) Notice: Subject to any disclaimer, the term of this patent is extended or adjusted under 35 U.S.C. 154(b) by 470 days.

(21) Appl. No.: 12/643,711

(22) Filed: Dec. 21, 2009

(65) Prior Publication Data

US 2010/0154920 A1 Jun. 24, 2010

(30) Foreign Application Priority Data

Dec. 20, 2008 (DE) ..... 10 2008 064 318

(51) Int. Cl.
*B65B 1/04* (2006.01)

(52) U.S. Cl. ..... 141/98; 222/571

(58) Field of Classification Search ..... 141/98, 141/128, 144, 192, 198; 222/571
See application file for complete search history.

(56) References Cited

U.S. PATENT DOCUMENTS

| | | | | |
|---|---|---|---|---|
| 4,244,404 | A * | 1/1981 | Brockner et al. | 141/146 |
| 5,137,187 | A * | 8/1992 | Nichols et al. | 222/504 |
| 5,816,456 | A * | 10/1998 | Graffin | 222/559 |
| 6,578,604 | B1 | 6/2003 | Adriansens | 137/614.2 |
| 6,997,439 | B2 | 2/2006 | Miyazaki et al. | 251/324 |
| 8,109,416 | B2 * | 2/2012 | Morand | 222/559 |
| 2009/0236007 | A1 | 9/2009 | Clusserath et al. | 141/9 |
| 2010/0071803 | A1 * | 3/2010 | Clusserath et al. | 141/65 |

FOREIGN PATENT DOCUMENTS

| | | |
|---|---|---|
| CN | 2677361 | 2/2005 |
| CN | 101590992 | 12/2009 |
| DE | 32 09 166 | 9/1983 |
| DE | 603 03 730 | 11/2006 |
| DE | 10 2006 045 987 | 4/2008 |
| GB | 2 116 530 | 9/1982 |
| WO | WO 2008/037338 | 3/2008 |

OTHER PUBLICATIONS

Chinese Second Office Action, dated Feb. 2, 2012 (6 pgs).
Chinese Official Action, dated Jan. 7, 2011 (6 pgs).

* cited by examiner

*Primary Examiner* — Gregory Huson
*Assistant Examiner* — Jason K Niesz
(74) *Attorney, Agent, or Firm* — Hayes Soloway P.C.

(57) ABSTRACT

Apparatus for filling containers with liquids and in particular with beverages, includes a reservoir for the liquid to be bottled and a connecting line for transporting the liquid from the reservoir to a filling device. The filling device has a first valve device for controlling a liquid flow into the container. The apparatus has a second valve device arranged in the connecting line in series with the first valve device, wherein the quantity of liquid flowing past the second valve device and the quantity of liquid reaching the filling device are essentially identical.

17 Claims, 2 Drawing Sheets

DEVICE FOR BOTTLING PARTICLE-CONTAINING BEVERAGES

BACKGROUND OF THE INVENTION

The present invention relates to a device for bottling liquids and in particular those liquids which contain particles, such as fruit juices which contain pieces of fruit for example. Various devices for bottling beverages are known from the prior art. It is customary that a liquid is conveyed from a reservoir via a connecting line into a filling device, and this filling device is in turn placed at a mouth of the container that is to be filled, in order to fill the latter with the liquid. These filling devices usually have valve mechanisms such as cone valves. These valve mechanisms allow a reliable and safe filling of conventional beverages into these containers. Sometimes, however, the bottling of beverages which contain particles is problematic, such as fruit juices which contain a relatively high proportion of large pieces of fruit for example.

In order to fill containers with still or else carbonated products, use is usually made of a filling valve which can be switched opened and closed by means of a cone or piston. The filling quantity is determined via the opening and closing of this cone. However, it is also possible to throttle the product in an inlet of the line, or else to make this throttle switchable in order to bottle for example at two different speeds.

When filling for example using the abovementioned free-jet filling system, a non-uniform distribution of the pieces of fruit at the cone may lead to splashing (also referred to as spillage) of the filling valve. These splashes are disadvantageous since they can lead for example to the formation of mould on the outside of the bottle. This problem occurs both at a start of a filling process and also at the end of the filling process or during a process of closing said valve. In particular, the free-jet valves known in the prior art have led to such undesirable splashes.

The object of the present invention is therefore to provide an apparatus and a method which allow an improved bottling of liquids. In particular, the intention is to provide a possibility for being able to bottle more efficiently even liquids which contain particles, such as pieces of fruit for example.

SUMMARY OF THE INVENTION

A device according to the invention for filling containers with liquids and in particular with beverages comprises a reservoir for the liquid to be bottled and a connecting line for transporting the liquid from the reservoir to a filling device, wherein the filling device has a first valve device for controlling a liquid flow into the container.

According to the invention, the device has a second valve device arranged in the connecting line in series with the first valve device, wherein the quantity of liquid flowing past the second valve device and the quantity of liquid reaching the filling device are essentially identical.

The prior art, for example WO 2008/037338 A1, discloses devices for bottling beverages, wherein a plurality of reservoirs are provided and also valves which ultimately serve for mixing these beverages originating from the different reservoirs. In these cases, however, the quantity of liquid flowing past the valves assigned to the respective reservoirs and of the liquid which ultimately reaches the filling device is different.

By contrast, the device according to the invention is configured in particular in such a way that the connecting line has no branches at least between the second valve device and the filling device so that, after the second valve device, no further liquids which have not already passed the second valve device can reach the filling device.

Essentially identical quantities of liquid is understood to mean that these quantities of liquid are identical or approximately identical in particular in a regular operating mode. Slight differences may result for example due to leakages between the two valve devices.

In one advantageous embodiment, the second valve device is configured in such a way that it completely interrupts the liquid flow to the filling device at least temporarily during a bottling process. As mentioned above, the problem of splashes occurs in particular if the liquid flows past the first valve device during an opening or closing process. By virtue of the procedure according to the invention, the second valve device can be used to interrupt a liquid flow to the filling device and to the first valve device. During an interruption of this liquid flow, the first valve device can then be fully opened, and the beverage can then be bottled without any splashes.

The invention therefore describes a system composed of two valve devices connected in series, wherein preferably the first valve device and the second valve device are switchable independently of one another, that is to say that the switching positions of these valves are not coupled to one another. It is pointed out here that the last valve device in the series before the outlet (into the container) need not necessarily be closed. Preferably, the second valve device is at a greater distance from the reservoir than from the first valve device. With particular preference, the second valve device is arranged close to the filling device, so that a product flow to the filling device can quickly be interrupted by a closing of this second valve device.

By virtue of the upstream valve, that is to say the second valve device, a valve cone of the first valve device for example can be lifted or opened without the product escaping. The product then runs in a temporally controlled manner through the relatively large flow cross-section which is now the same right from the start. This prevents any deflection of the jet due to jammed pieces of fruit in a small cross-section. During a closing process, splashing can also be avoided here due to an early closing of the product flow by means of the second valve device. In other words, the product flow is switched off over a large cross-section and then the first valve device is immediately closed or else a gap remains open which is preferably so small that the product to be bottled does not automatically run out of the valve.

Preferably, a further valve device is provided which is arranged on said reservoir for the liquid. The quantity of liquid which passes from the reservoir into the connecting line is thus also variable. However, a further valve device may also be arranged in a supply line to the reservoir.

In a further advantageous embodiment, the apparatus has a control device which is configured in such a way that it controls the first valve device and the second valve device as a function of one another during a bottling process with a certain liquid. It is thus possible—as described above—that, at the start of a process of filling into a certain container, firstly the first valve device is opened and only then is the second valve device opened.

Preferably, the apparatus is designed for bottling particle-containing beverages. This may be expressed for example in the nature of the flow cross-sections of the two valve devices.

In a further advantageous embodiment, a flow measuring device is arranged upstream of the second valve device between the reservoir and the second valve device. A determination of the bottling quantity by means of weighing cells or other measurement methods is also conceivable.

In a further advantageous embodiment, the first valve device comprises a displaceable valve cone. This valve cone can in this case reduce or completely close a flow cross-section.

In a further advantageous embodiment, at least one valve device, and particularly preferably at least the second valve device, allows stationary valve positions which lie between a complete opening and a complete closing of the second valve device. In this way, as a function of a beverage to be bottled, a certain closed state or open state of the valve can be freely defined which may differ from an absolutely closed state or also a completely open state. For example, it is possible that the second valve device can be controlled or switched between an open position in which the flow volume is slightly limited and a closed position in which the product flow is only almost completely limited. Preferably, at least one such stationary valve position can be set. Preferably, a plurality of such stationary intermediate positions of the second valve device are possible.

The present invention also relates to a method for bottling liquids into containers, wherein the liquids are conveyed in particular via a connecting line to a filling device and are filled into the containers by means of the filling device, and wherein a first valve device arranged in the filling device influences or controls a liquid flow from the filling device into the container. According to the invention, the liquid is conveyed via a second valve device arranged in the connecting line, wherein the quantity of liquid flowing past this second valve device essentially corresponds to the quantity of liquid arriving at the filling device.

It is thus also proposed with regard to the method to provide two valves in series which cooperate during the filling of the containers. Preferably, at least once during a bottling process, firstly the first valve device is at least partially opened while the second valve device is still closed and then the second valve device is opened. Preferably, at least one of the valve devices is at least at times completely open, and in particular the first valve device is at times completely open.

Preferably, at the start of a process of bottling the liquid into a certain container, firstly the first valve device is at least partially opened and only then is the second valve device at least partially opened (from a closed state). By virtue of this procedure—as mentioned above—the occurrence of splashes due to pieces of fruit jammed in the first valve device can be avoided.

In a further advantageous method, at least once during the bottling process and in particular at the end of the process of bottling the liquid into a certain container, firstly the second valve device is at least partially closed and then the first valve device is at least partially closed. In this way, the occurrence of splashes can be avoided also during the process of closing the valves.

Preferably, a particle-containing beverage is used as the liquid. Further advantageous embodiments will emerge from the appended drawings.

DETAILED DESCRIPTION OF THE INVENTION

Figure 1:
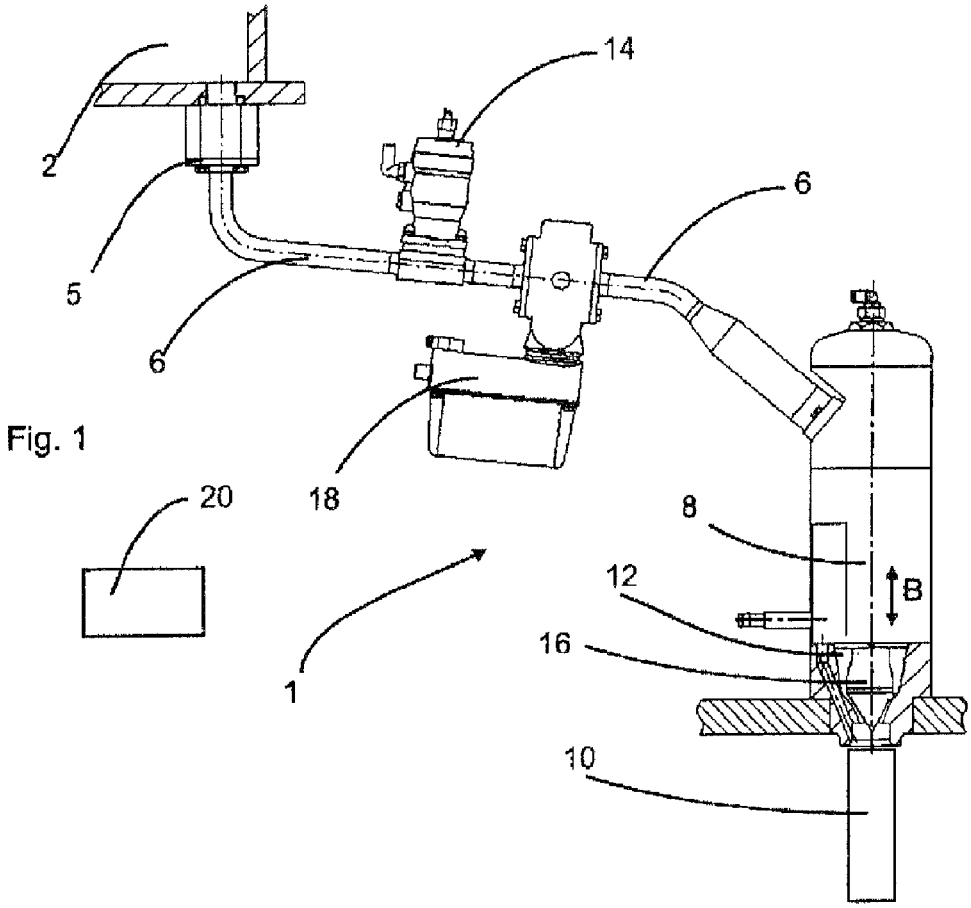
FIG. 1 shows a schematic view of an apparatus according to the invention.

FIG. 1 shows a device 1 according to the invention. This device 1 comprises a reservoir 2, in which a beverage to be bottled is arranged. Connected to this reservoir 2 via a flange connection 5 is a connecting line 6 which serves for conveying the liquid or beverage to a filling device 8. This filling device 8 serves for bottling the liquid into a container 10 via a container mouth. In order to bottle the beverage, the filling device 8 comprises a first valve device 12 which here has a valve cone 16 movable in the direction B, which valve cone can influence a passage of the liquid depending on the position of this valve cone or can even completely block the flow of liquid. In the embodiment shown in FIG. 1, the connecting line directly adjoins the reservoir 2. However, it would also be possible that further elements, such as distributor units for example, are arranged between the reservoir and the connecting line 6. It is also pointed out that the reservoir and the configuration thereof are not critical for the functioning of the proposed invention. A connecting line could also serve as a reservoir for the beverage.

Furthermore, there is arranged in the connecting line 6 a second valve device 14 which is thus connected in series with the first valve device 12 in respect of the liquid flow. This second valve device 14 is able to interrupt the flow of liquid completely. Preferably, the second valve device is a pneumatic shut-off valve or a membrane valve.

A flow measuring device 18 is provided between the second valve device 14 and the filling device 8. It is thus possible for the liquid flow to be in particular completely blocked also by the second valve device 14. During this closed state, an open state of the first valve device 12 can be varied, for example at the start of a filling process the first valve device 12 can be completely open during this period.

Reference 20 denotes a control device for controlling the two valve devices 12, 14. This control may take place in such a way that both at the start of the filling process and also at the end thereof the second valve device 14 completely blocks the flow while the first valve device alternates between an open position to a closed position and vice versa.

Figure 2:
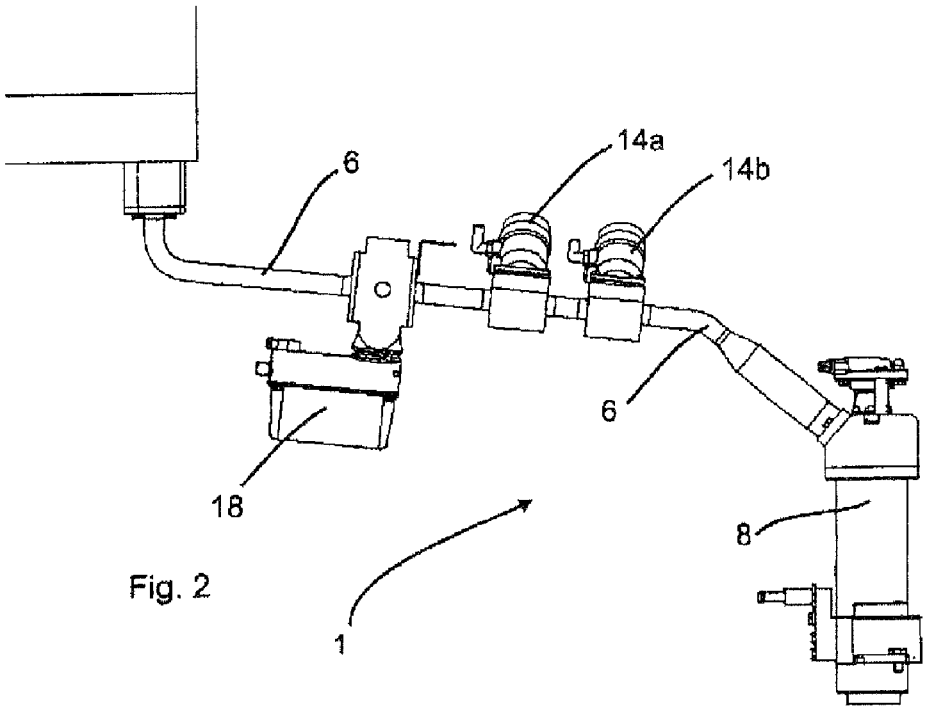
FIG. 2 shows a further embodiment of an apparatus according to the invention.

FIG. 2 shows a further embodiment of a device according to the invention. In this embodiment, two valve devices 14*a*, 14*b*, more specifically membrane valves, are provided one behind the other in the connecting line 6. These two valve devices 14*a*, 14*b* make it possible to implement different rates of filling into the container 10. The two valve devices 14*a*, 14*b* are also controllable independently of one another. These two valve devices 14*a*, 14*b* can in each case be completely closed, but allow different maximum fluid flows in their respective open positions.

Figure 3:
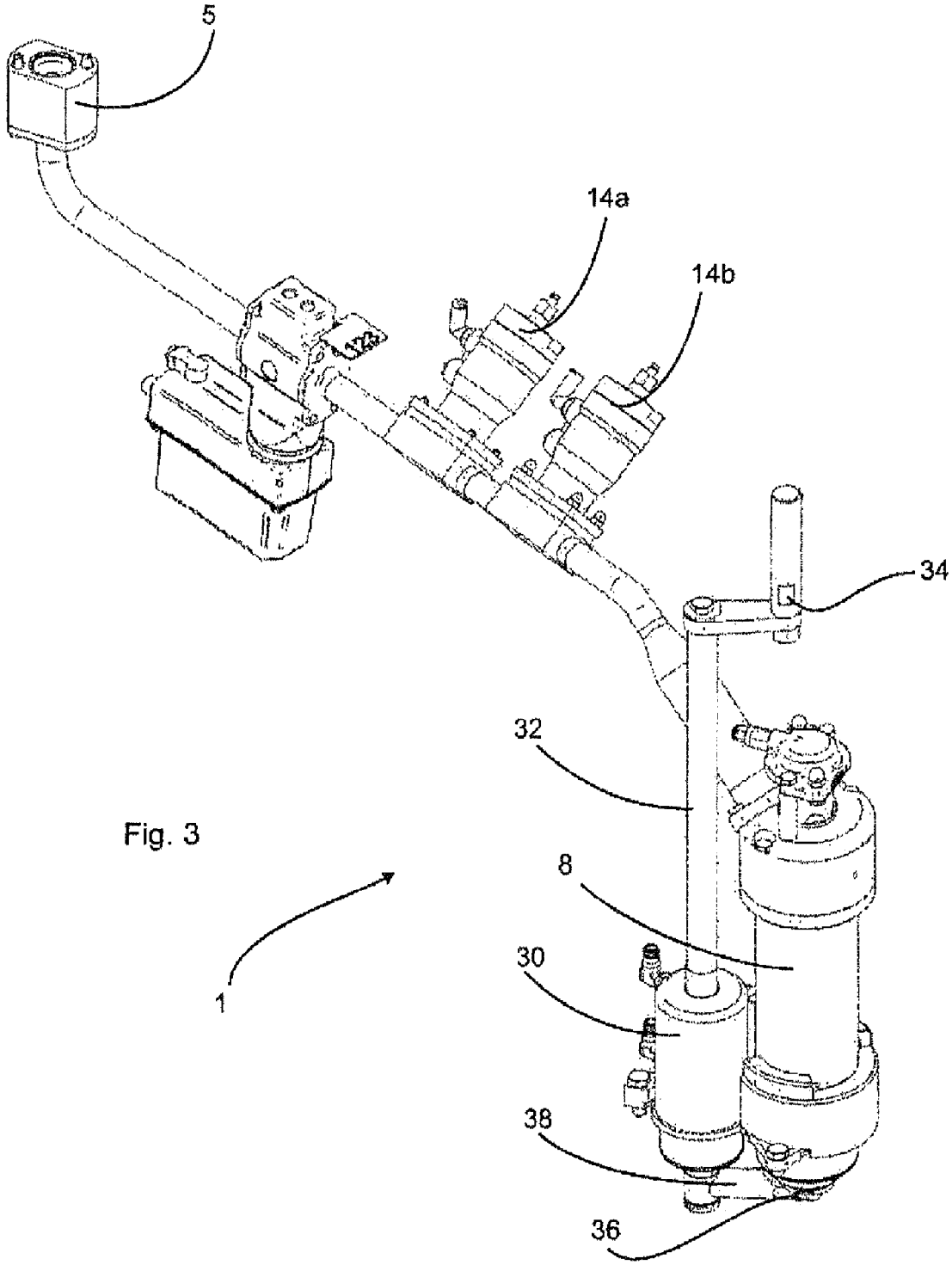
FIG. 3 shows a further embodiment of an apparatus according to the invention.

In the embodiment shown in FIG. 3, in addition to the two valve devices 14*a*, 14*b*, an additional closure cap mechanism or CIP cap mechanism is provided for cleaning purposes. In this embodiment, this closure cap mechanism comprises a pivotable CIP cap 36, which is controllable by moving a lever 34 and thus by using a cam (not shown). A rod 32 transmits the movement of the lever 34 to a lever 38 and thus the CIP cap 36. A lifting element 30 lifts the CIP cap 36 and thus presses the latter against the filling device 8.

All of the features disclosed in the application documents are claimed as essential to the invention in so far as they are novel individually or in combination with respect to the prior art.

The invention claimed is:

1. A device for filling containers with liquids, comprising a reservoir for the liquid to be bottled and a connecting line for transporting the liquid from the reservoir to a filling device, wherein the filling device has a first valve device for controlling a liquid flow into the container, and a second valve device arranged close to the filling device, in the connecting line, in series with the first valve device, wherein the quantity of liquid flowing past the second valve device and the quantity of liquid reaching the filling device are essentially identical, and wherein the second valve device is a pneumatic shut-off valve or a membrane valve.

2. The device according to claim 1,
wherein
the second valve device is configured in such a way that it completely interrupts the liquid flow to the filling device at least temporarily during a bottling process.

3. The device according to claim 1,
wherein
the first valve device and the second valve device are switchable independently of one another.

4. The device according to claim 1,
wherein
the apparatus has a control device which is configured in such a way that it controls the first valve device and the second valve device as a function of one anothers state during a bottling process.

5. The device according to claim 1,
wherein
the apparatus is designed for bottling particle-containing beverages.

6. The device according to claim 1,
wherein
a flow measuring device is arranged between the reservoir and the second valve device.

7. The device according to claim 1,
wherein
the first valve device comprises a displaceable valve cone.

8. The device according to claim 1,
wherein
at least the second valve device allows stationary valve positions which lie between a complete opening and a complete closing of the second valve device.

9. A method for bottling liquids into containers, wherein the liquids are conveyed from a reservoir via a connecting line to a filling device and are filled into the containers by the filling device, and a first valve device arranged in the filling device influences a liquid flow from the filling device into the container,
wherein
the liquid is conveyed via a second valve device which is a pneumatic shut-off valve or a membrane valve arranged in the connecting line close to the filling device,
wherein the quantity of liquid flowing past this second valve device essentially corresponds to the quantity of liquid arriving at the filling device.

10. The method according to claim 9,
wherein,
at least once during a bottling process, the first valve device is at least partially opened and then the second valve device is at least partially opened.

11. The method according to claim 9,
wherein,
at the start of a process of bottling the liquid into certain container, the first valve device is at least partially opened and then the second valve device is at least partially opened.

12. The method according to claim 9,
wherein,
at least once during a process of bottling the liquid into a certain container, the second valve device is at least partially closed and then the first valve device is at least partially closed.

13. The Method according to claim 9,
wherein
the liquid comprises a beverage.

14. The method according to claim 13, wherein the liquid comprises a particle-containing beverage.

15. The device according to claim 1,
wherein
a flow measuring device is provided between the second valve device and the filling device.

16. The device according to claim 1,
wherein
two valve devices are provided in the connecting line.

17. The device according to claim 1,
wherein
a closure cap mechanism or CIP (clean-in-place) cap mechanism is provided for cleaning purposes of the filling device.

* * * * *

UNITED STATES PATENT AND TRADEMARK OFFICE

CERTIFICATE OF CORRECTION

PATENT NO. : 8,353,320 B2
APPLICATION NO. : 12/643711
DATED : January 15, 2013
INVENTOR(S) : Poeschl It is certified that error appears in the above-identified patent and that said Letters Patent is hereby corrected as shown below:

In the Claims

Claim 11, Col. 6, line 14 “into certain” should be --into a certain--

Signed and Sealed this
Twenty-sixth Day of August, 2014

Michelle K. Lee

Michelle K. Lee
*Deputy Director of the United States Patent and Trademark Office*